US007156170B2

(12) United States Patent
Fotland et al.

(10) Patent No.: US 7,156,170 B2
(45) Date of Patent: Jan. 2, 2007

(54) METHODS AND APPARATUS FOR SEVERING NESTED STRINGS OF TUBULARS

(75) Inventors: Per Fotland, Hundvaag (NO); Tor Jan Akerlund, Forus (NO)

(73) Assignee: Weatherford/Lamb, Inc.

( * ) Notice: Subject to any disclaimer, the term of this patent is extended or adjusted under 35 U.S.C. 154(b) by 4 days.

(21) Appl. No.: 11/006,050

(22) Filed: Dec. 7, 2004

(65) Prior Publication Data

US 2005/0082063 A1 Apr. 21, 2005

Related U.S. Application Data

(63) Continuation-in-part of application No. 10/101,497, filed on Mar. 19, 2002, now Pat. No. 6,827,145, which is a continuation-in-part of application No. 09/355,439, filed as application No. PCT/GB97/03174 on Nov. 19, 1997, now Pat. No. 6,412,553.

(60) Provisional application No. 60/277,439, filed on Mar. 20, 2001.

(30) Foreign Application Priority Data

Jan. 29, 1997 (GB) ..... 9701790.9

(51) Int. Cl.
*E21B 29/00* (2006.01)
*E21B 19/00* (2006.01)

(52) U.S. Cl. ..... 166/77.51; 166/55; 166/298; 81/57.35

(58) Field of Classification Search ..... 166/378, 166/379, 381, 382, 297, 298, 55, 65.1, 66.4, 166/75.11, 77.1, 77.4, 77.51, 85.1, 242.1, 166/242.7; 175/52, 85; 81/57.35
See application file for complete search history.

(56) References Cited

U.S. PATENT DOCUMENTS

| | | | |
|---|---|---|---|
| 2,668,689 | A | 2/1954 | Cormany |
| 2,692,059 | A | 10/1954 | Bolling, Jr. |
| 3,253,336 | A | 5/1966 | Brown |
| 3,392,609 | A | 7/1968 | Bartos |
| 3,518,903 | A | 7/1970 | Ham et al. |
| 3,561,526 | A | 2/1971 | Williams et al. |
| 3,603,387 | A | 9/1971 | Schoeffler |
| 3,766,979 | A | 10/1973 | Petrick |
| 3,838,613 | A | 10/1974 | Wilms |
| 3,839,791 | A | 10/1974 | Feamster |
| 3,840,128 | A | 10/1974 | Swoboda, Jr. et al. |
| 3,863,667 | A | 2/1975 | Ward |

(Continued)

FOREIGN PATENT DOCUMENTS

| | | |
|---|---|---|
| EP | 0 778 392 A2 | 6/1997 |

(Continued)

OTHER PUBLICATIONS

International Search Report, International Application No. PCT/GB 02/01339, dated Nov. 6, 2002.

*Primary Examiner*—Jennifer H. Gay
(74) *Attorney, Agent, or Firm*—Patterson & Sheridan, LLP.

(57) ABSTRACT

An apparatus and method for use in severing casing as it is pulled from a wellbore. In one aspect, the apparatus, includes a clamping assembly, a drilling assembly and a cutting assembly. The apparatus is disposed at the end of a telescopic arm, with the components being remotely operated by personnel using a control panel. The apparatus is positioned adjacent casing and clamped thereto. Thereafter, the apparatus drills a hole completely through the casing for the insertion of a retention pin. The apparatus then severs the casing.

31 Claims, 8 Drawing Sheets

U.S. PATENT DOCUMENTS 3,881,375 A 5/1975 Kelly
3,881,385 A * 5/1975 Coy ..... 83/410.9
3,885,679 A 5/1975 Swoboda, Jr. et al.
3,980,143 A 9/1976 Swartz et al.
4,077,525 A 3/1978 Callegari et al.
4,181,196 A 1/1980 Darby et al.
4,194,383 A 3/1980 Huzyak
4,227,197 A 10/1980 Nimmo et al.
4,229,121 A * 10/1980 Brown ..... 405/158
4,274,777 A 6/1981 Scaggs
4,277,197 A 7/1981 Bingham
4,437,237 A * 3/1984 Ducret ..... 30/90.2
4,440,220 A 4/1984 McArthur
4,492,136 A * 1/1985 Walker ..... 83/169
4,493,150 A 1/1985 Garcia et al.
4,506,480 A * 3/1985 Murrill et al. ..... 52/121
4,557,628 A * 12/1985 Cowan ..... 405/191
4,604,724 A 8/1986 Shaginian et al.
4,625,603 A * 12/1986 Vanden Brink ..... 83/74
4,652,195 A 3/1987 McArthur
4,681,158 A 7/1987 Pennison
4,686,873 A 8/1987 Lang et al.
4,691,587 A 9/1987 Farrand et al.
4,725,179 A 2/1988 Woolslayer et al.
4,832,552 A 5/1989 Skelly
4,843,945 A 7/1989 Dinsdale
4,921,386 A 5/1990 McArthur
5,049,020 A 9/1991 McArthur
5,060,542 A 10/1991 Hauk
5,062,756 A * 11/1991 McArthur et al. ..... 414/22.51
5,176,518 A 1/1993 Hordijk et al.
5,263,660 A * 11/1993 Brozik ..... 254/269
5,294,228 A 3/1994 Willis et al.
5,354,150 A 10/1994 Canales
5,368,113 A 11/1994 Schulze-Beckinghausen
5,386,746 A 2/1995 Hauk
5,509,440 A 4/1996 Cantaloube et al.
5,623,994 A * 4/1997 Robinson ..... 166/379
5,661,888 A 9/1997 Hanslik
5,667,026 A 9/1997 Lorenz et al.
5,711,382 A 1/1998 Hansen et al.
5,829,605 A * 11/1998 Poitras ..... 212/180
5,907,664 A 5/1999 Wang et al.
5,931,231 A 8/1999 Mock
6,038,954 A * 3/2000 Keener ..... 83/795
6,067,716 A * 5/2000 Carter ..... 30/92
6,131,597 A 10/2000 Mendicino et al.
6,412,553 B1 7/2002 Akerlund
2002/0035897 A1* 3/2002 Buytaert et al. ..... 81/57.35

FOREIGN PATENT DOCUMENTS

FR 2 053 088 10/1973
FR 2 313 859 A 12/1997
GB 1 469 661 7/1974
GB 2 201 912 9/1988
GB 2 285 077 6/1995
WO WO 90/06418 6/1990
WO WO 92/18743 10/1992
WO WO 95/10686 4/1995
WO WO 99/11902 3/1999

* cited by examiner

FIG. 11A
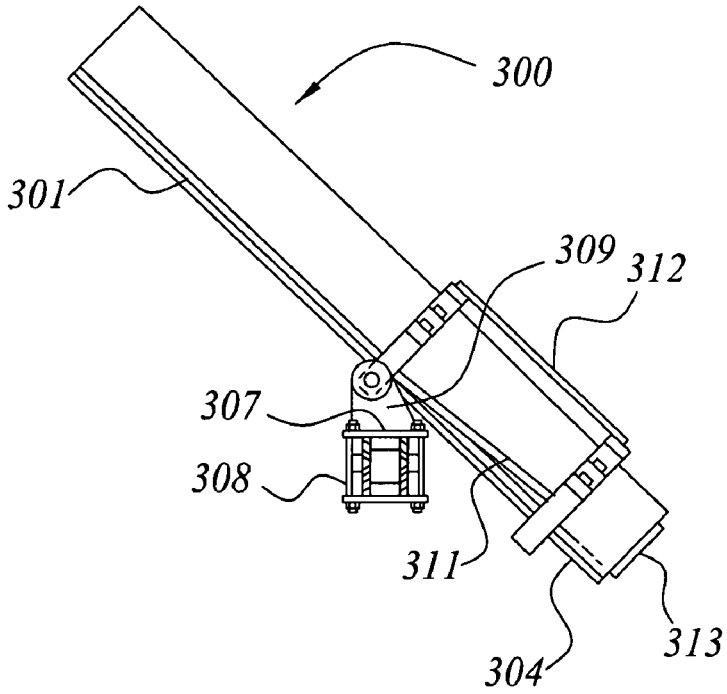
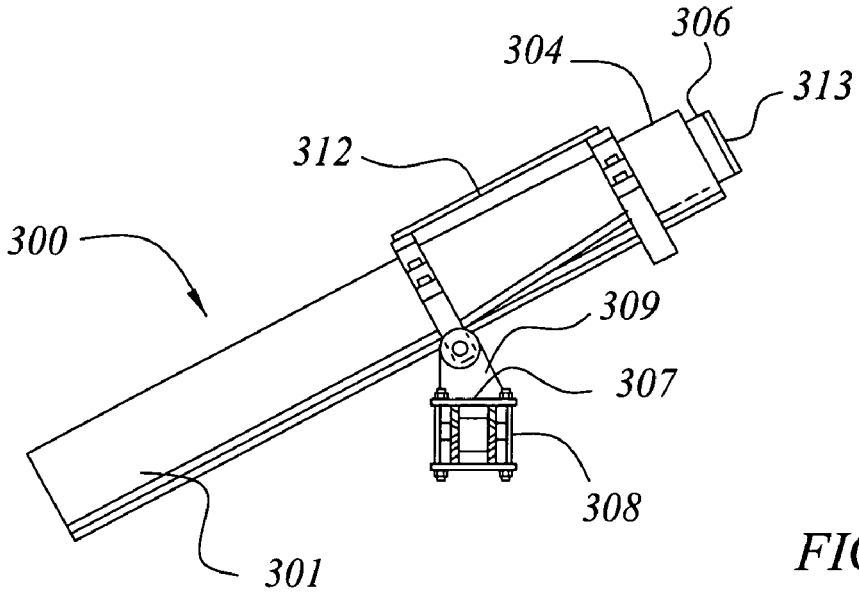
FIG. 11B

METHODS AND APPARATUS FOR SEVERING NESTED STRINGS OF TUBULARS

CROSS-REFERENCE TO RELATED APPLICATIONS

This application is a continuation of U.S. patent application Ser. No. 10/101,497 filed Mar. 19, 2002, now U.S. Pat. No. 6,827,145. U.S. patent application Ser. No. 10/101,497 claims priority to U.S. Provisional Application No. 60/277,439, filed Mar. 20, 2001. U.S. patent application Ser. No. 10/101,497 is a continuation-in-part of U.S. patent application Ser. No. 09/355,439, filed Nov. 29, 1999, now U.S. Pat. No. 6,412,553. That application is entitled "Apparatus for Positioning a Tong, and Drilling Rig Provided with Such an Apparatus." The grandparent application was the National Stage of International Application No. PCT/GB97/03174, filed Nov. 19, 1997 and published under PCT Article 21(2) in English, and claims priority of United Kingdom Application No. 9701790.9 filed on Jan. 29, 1997. Each of the aforementioned related patent applications is herein incorporated in its entirety by reference.

BACKGROUND OF THE INVENTION

FIELD OF THE INVENTION

The present invention generally relates to plugging and abandonment of oil and gas wells. More particularly, the present invention relates to the removal of a tubular from a wellbore in order to satisfy various environmental regulations. More particularly still, the invention relates to severing nested strings of tubulars that are cemented together in order to more easily handle the tubulars as they are removed from a wellbore during or subsequent to a plugging and abandonment operation.

In the completion of oil and gas wells, boreholes are formed in the earth and thereafter are lined with steel pipe known as casing. An annular area formed between the outside of the casing and the wall of the borehole is typically filled with cement in order to secure the casing in the borehole and to facilitate the isolation of certain areas of the wellbore for the collection of hydrocarbons. In most instances, because of the depth of a wellbore, concentric strings of tubulars are disposed in the wellbore with each lower string of tubulars being necessarily smaller in diameter than the previous string. In some cases, especially in offshore oil and gas wells, the strings are run in a nested fashion from the surface of the well. In other words, a first string of casing is cemented into the wellbore and, subsequently, a second smaller string of casing is cemented into the first string to permit the borehole to be lined to a greater depth. This process is typically repeated with additional casing strings until the well has been drilled to total depth. In this manner, wells are typically formed with two or more strings of casing of an ever-decreasing diameter.

When a decision is made to no longer operate a hydrocarbon well, the wellbore is typically plugged to prevent formation fluids from migrating towards the surface of the well or into a different zone. Various environmental laws and regulations govern the plugging and abandonment of wellbores. These regulations typically require that the wellbore be filled with some amount of cement. In some instances, the cement must be squeezed into the annular area around the cemented casing in order to prevent fluids from migrating up towards the surface of the well on the outside of the casing through any cement gaps. In offshore wells, regulations typically require not only the foregoing steps, but also that a certain amount of wellbore casing be completely removed from the wellbore. For example, in some instances, the upper 1,000 feet of casing extending downward from the ocean floor into the wellbore must be removed to complete a plugging and abandonment operation.

Various methods and techniques have been developed and are currently utilized in order to remove casing from an offshore wellbore. Most often, some type of cutting device is run into the wellbore on a wireline or string of tubulars. The cutting device is actuated in order to sever the casing at a predetermined depth, creating separate upper and lower strings of casing. Thereafter, the upper string is pulled and brought to the surface.

Because of the great length and weight of the upper string of casing being removed, it is necessary to further sever the upper casing string as it is retrieved at the surface. Accordingly, the casing is further severed into predetermined lengths. This makes handling and disposal of the removed casing more efficient.

In some instances, the severed upper string of casing includes more than one set of tubulars. In other words, there is a first outer string of casing, and then a second smaller string of casing nested therein. In one example, the outer casing string is 13⅜ inches in diameter, and the smaller casing nested therein is 9⅝ inches in diameter. These two strings of severed casing will typically be joined by a layer of cement within the annular area. This cement layer adds to the weight of the severed casing string, making it even more desirable to cut the retrieved pipe into manageable sections.

A casing string is typically comprised of a series of joints that are 30 feet in length. The pipe joints are connected by threaded male-to-female connections. When retrieving a severed casing string during a plug and abandonment procedure, it is desirable to break the pipe string by unthreading the connected joints. However, this process is difficult where the severed string consists of outer and inner pipe strings cemented together. Further, there is little incentive to incur the time necessary to break the joints apart at the threads, as the pipe joints from an abandoned well will typically not be re-used. For these reasons, the severed casing is typically broken into smaller joints by cutting through the inner and outer strings at the surface of the well. The severed pipe sections are then recycled or otherwise disposed of.

In a conventional plug and abandonment operation, casing strings are severed generally as follows:

First, the casing string is severed within the wellbore. Typically, severance is accomplished at a depth of around 1,000 feet. Thereafter, the severed portion of casing is "jacked" out of the wellbore and raised to the surface of the rig platform using a platform-mounted elevator. As the upper end of the severed casing section reaches the floor of the platform, it is lifted to a predetermined height above a set of slips. The slips are then set, suspending the severed string of casing above the rig floor. A drilling machine then drills a hole completely through the casing, including any cement layer and smaller diameter casing which is cemented within the larger diameter casing. Thereafter, a pin or other retainer is inserted through the drilled hole to ensure that the smaller string of casing is anchored to the larger string. This method of drilling a hole through the casing and inserting a retainer pin is necessary to ensure that the smaller string of casing does not become dislodged from the larger string due to some failure of the cement layer there between.

After the inner casing string and cement there around is anchored to the larger outer string, a band saw is used to cut the severed tubular into a predetermined length. The band saw operates with coolant to avoid the use of high temperature cutters or the production of sparks. Typically, a length of ten feet (alternatively, between fifteen and thirty feet) is selected, with the cut being made above the retention pin. The newly severed, ten-foot portion of string is then transported to a barge or other transportation means for disposal or salvage.

With the slips disengaged, the elevator then raises the severed string of casing another length of approximately ten feet. The slips are then re-engaged and the drilling, anchoring and cutting procedure takes place again.

While the foregoing apparatus and method are adequate to dispose of strings of concentrically cemented casing, the operation necessarily requires personnel to be at the drilling mechanism and the band saw during the operation. The presence of personnel on a platform inherently carries risk. The risk is magnified when the personnel must be in close contact with the operating machinery.

There is a need, therefore, for a method and apparatus of disposing of concentric strings of tubular during a plugging and abandonment operation which does not require personnel to be located directly at the machinery performing the cutting operations. There is a further need for a method and apparatus which can be operated remotely by well platform personnel. There is yet a further need for an apparatus and method that can more safely and effectively sever strings of casing at a well site.

SUMMARY OF THE INVENTION

The present invention generally provides an apparatus and method for severing predetermined lengths of nested casing above a drilling rig or workover rig platform. The apparatus includes a clamp assembly, a drill assembly and a cutting assembly. In one aspect, the clamp assembly, the drilling assembly and the cutting assembly are disposed at the end of a telescopic arm, and are remotely operated by personnel using a control panel. In accordance with the present invention, the clamp assembly is positioned adjacent a section of casing to be severed, and then clamped thereto. Thereafter, the drilling assembly is actuated so as to drill a hole completely through the casing strings. A retention pin is then inserted through the newly formed aperture. Finally, the cutting assembly, such as a band saw, is actuated so as to severe the casing above the pin. The newly severed portion of casing above the pin may then be disposed of.

There is also a need to be able to move the cutting machinery out of the way when not in use to facilitate other operations on the rip floor and to use existing rig structure to support the cutting machinery so as not to occupy valuable rig floor space with the addition of a support beam.

BRIEF DESCRIPTION OF THE DRAWINGS

So that the manner in which the features of the present invention are attained and can be understood in detail, a more particular description of the invention, briefly summarized above, may be had by reference to the appended drawings. It is to be noted, however, that the appended drawings illustrate only typical embodiments of this invention and are therefore not to be considered limiting of its scope, for the invention may admit to other equally effective embodiments.

FIG. 3 is a perspective view of a cross-sectional cut of a casing section. The pipe section is comprised of an outer casing string, an inner casing string and a layer of cement there between.

FIG. 11A is a perspective view showing the alternative cantilevered arm of FIG. 10 in a first inoperative position. FIG. 11B is a perspective view showing the alternative cantilevered arm of FIG. 10 in a second inoperative position.

DETAILED DESCRIPTION OF THE PREFERRED EMBODIMENT

The present invention provides a method and apparatus for severing casing that has been removed from a wellbore.

Figure 1:
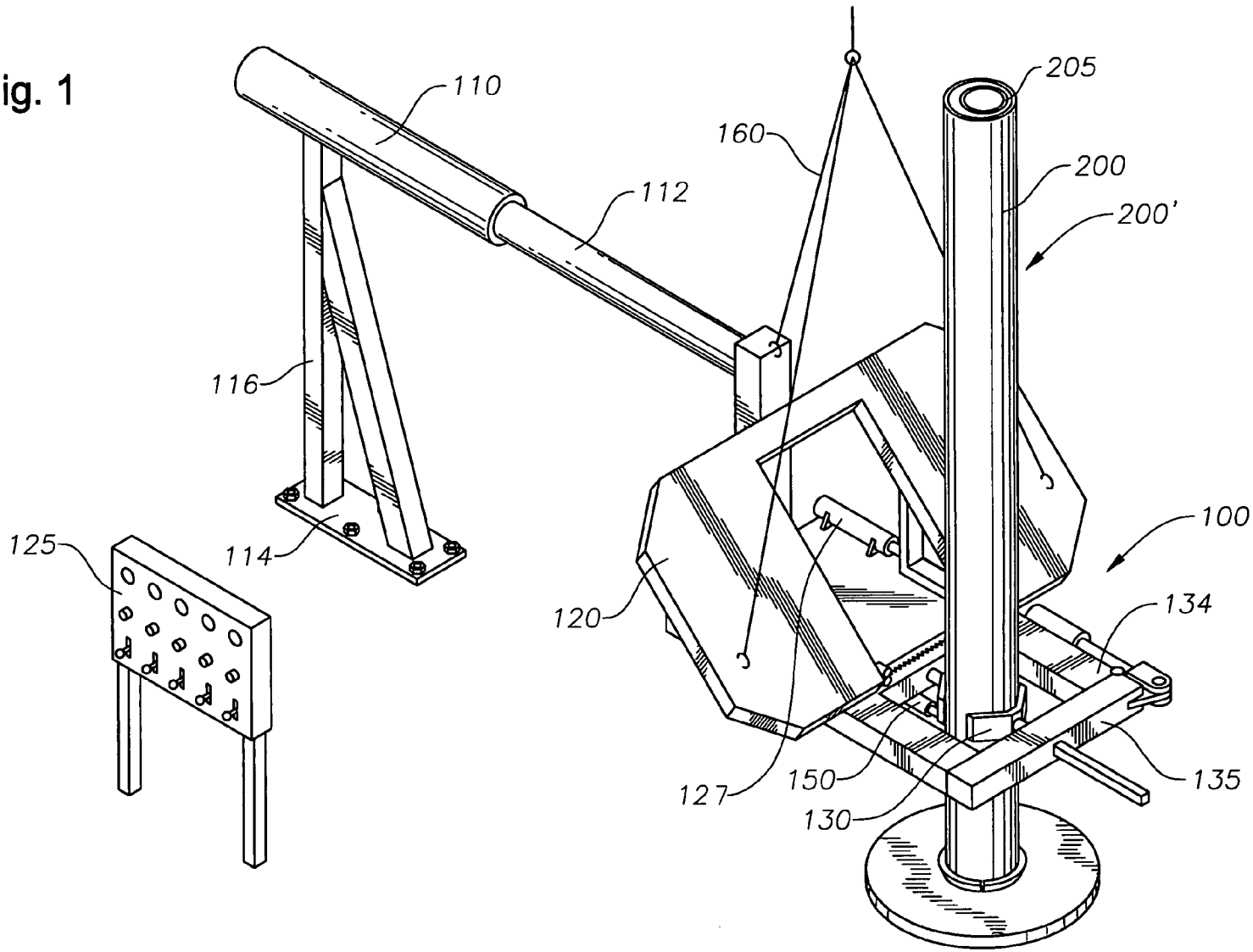
FIG. 1 is a perspective view of the tubular severing apparatus of the present invention, in one arrangement.

FIG. 1 provides a perspective view of a novel tubular cutting apparatus 100 of the present invention, in one embodiment. The apparatus 100 comprises a clamp assembly 130, a drill assembly 150 and a cutting assembly. The apparatus 100 is selectively movable. In one aspect, the apparatus 100 is disposed at the end of an extendable structure. In FIG. 1, the extendable structure is shown as a cantilevered arm 110. The exemplary arm 110 defines an outer barrel 110 having at least one telescoping section 112 extending therefrom. An intermediate telescoping section (not shown) may also be incorporated. In such an arrangement, the end telescoping section 112 is slidably mounted in the intermediate telescoping section which is, in turn, slidably mounted in the outer barrel 110.

The arm 110 is supported by a base 114 secured to the floor of a rig platform (not shown). The arm 110 is disposed along a vertical support beam 116 vertically extending above the base 114. In the grandparent application, the outer barrel of the arm 110 is described as being attached to the support beam 116 by means of a clamp (not shown in FIG. 1) bolted to the top of the beam 116. The clamp maintains the arm 110 in position with respect to the beam 116. In one aspect, the arm 110 is pivotally attached to the support beam 11 '3 to permit the tubular severing apparatus 100 to pivot about a vertical axis and, alternatively or in addition, a horizontal axis. In one aspect, the clamp is releasably attached to the support beam 116.

Figure 4:
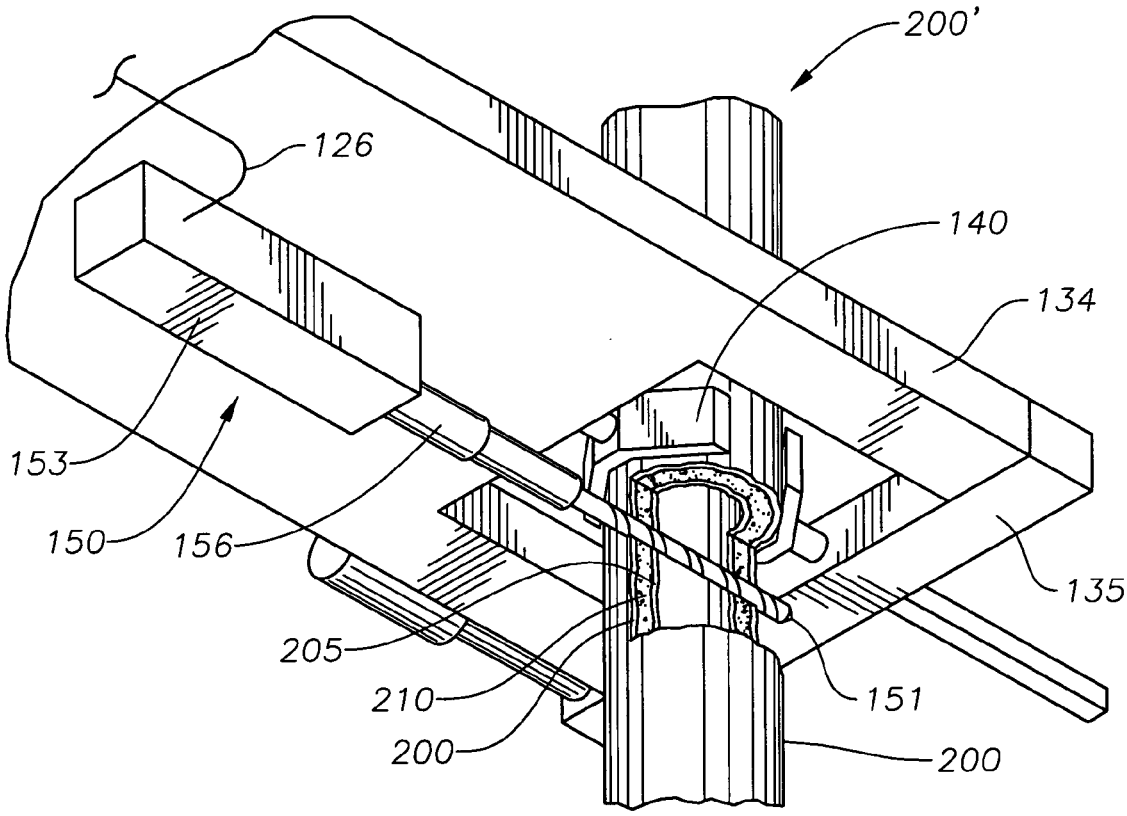
FIG. 4 is a side view illustrating a drilling assembly of the present invention. The drilling assembly is shown drilling a hole through a casing section.

An additional feature of the arm 110 described more fully in the grandparent application is that the outer barrel 110 of the arm itself may be selectively moved with respect to the support beam 116. This means that the entire arm 110 may be retracted away from the casing section 200'. When the telescoping sections 112 are fully contracted, the free end of the arm 110 lies closely adjacent the support beam 116. This retracting feature is shown in FIG. 11A and FIG. 4 of the grandparent application with respect to a tong, but may also be employed in the present application with respect to a tubular severing assembly 100.

Figure 10A:
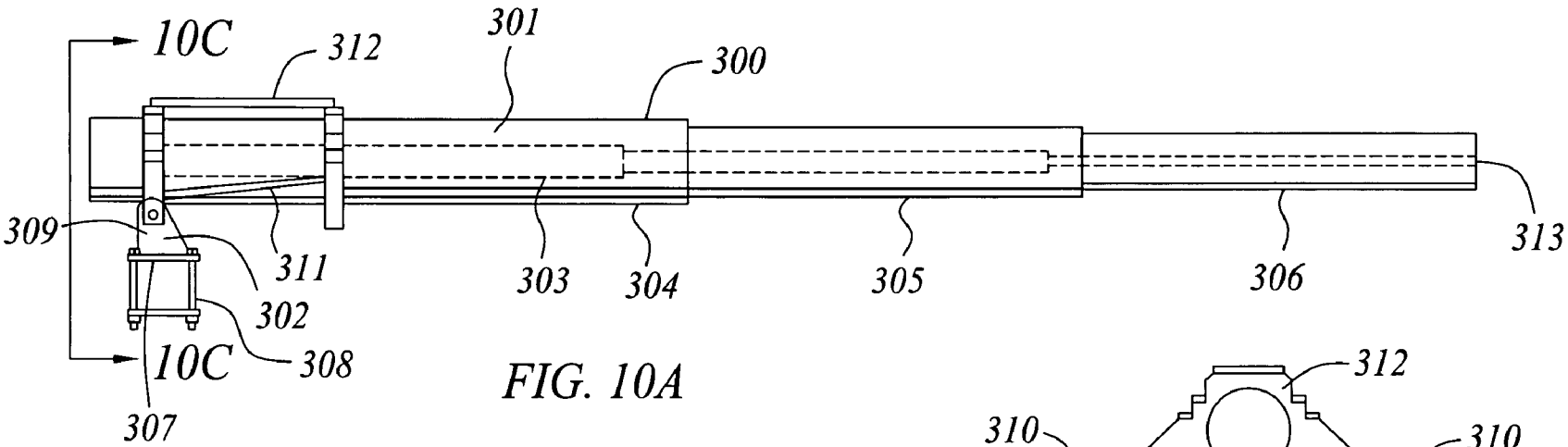
FIG. 10A is a side elevation of an alternative cantilevered arm.
Figure 10C:
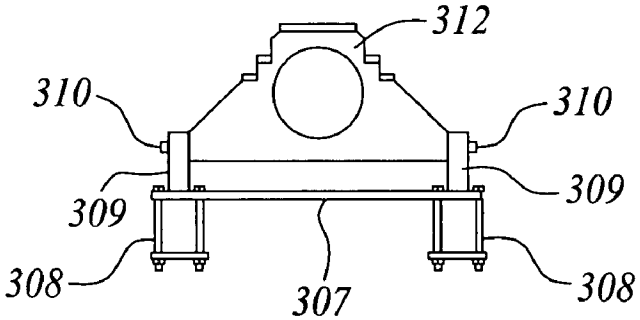
FIG. 10C is an end view taken on line III—III of FIG. 10A.
Figure 10B:
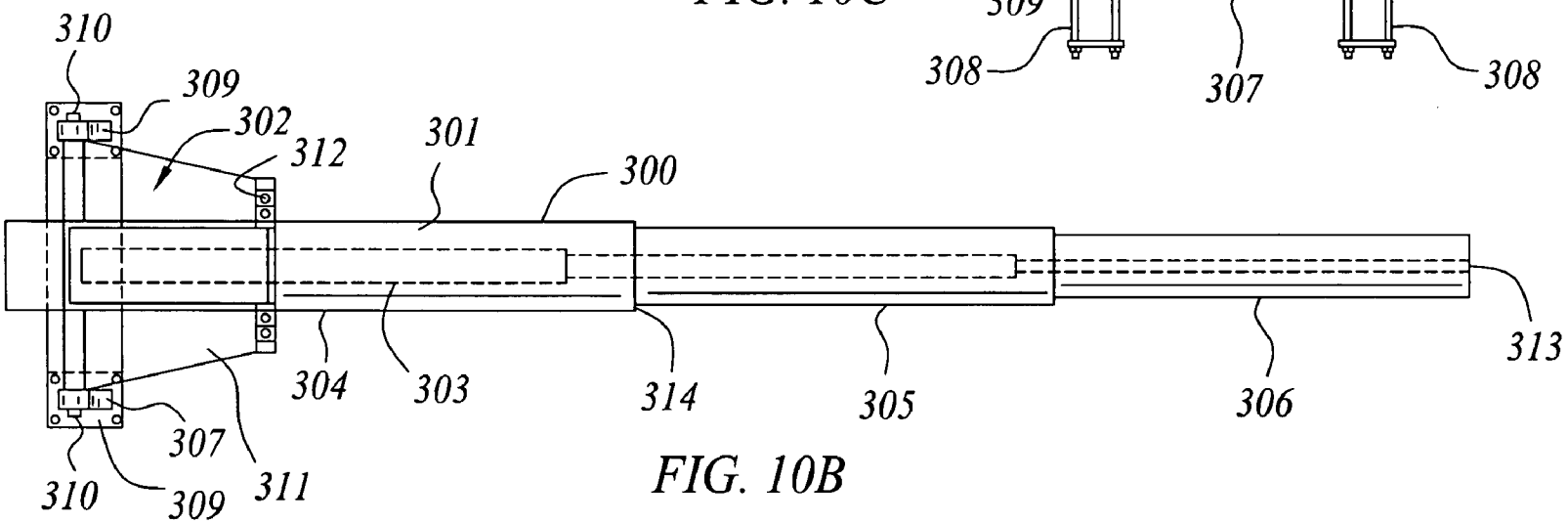
FIG. 10B is a top plan view of the arm shown in FIG. 10A.

FIG. 10A is a side elevation of an alternative cantilevered arm 300. FIG. 10B is a top plan view of the arm 300 shown in FIG. 10A. FIG. 10C is an end view taken on line III—III of FIG. 10A. The arm, which is generally identified by the reference numeral 300, comprises a piston and cylinder assembly 301 and a mounting assembly 302. The piston and cylinder assembly 301 comprises a conventional two stage hydraulic piston and cylinder 303 which is mounted internally of a telescopic structure which comprises an outer barrel 304, an intermediate barrel 305 and an inner barrel 306. The inner barrel 306 is slidably mounted in the intermediate barrel 305 which is, in turn, slidably mounted in the outer barrel 304. The mounting assembly 302 comprises a bearer 307 which can be secured to the support beam 116 by two bolt and plate assemblies 308. The bearer 307 includes two ears 309 which accommodate trunnions 310 which proiect from either side of a carriage 311. A clamp assembly 312 is bolted to the top of the carriage 311 and maintains the piston and cylinder assembly 301 in position with respect to the mounting assembly 302.

In use, the mounting assembly 302 is first secured to a convenient support beam in the drilling rig by bolt and plate assemblies 308. Typically, said mounting assembly will be mounted on a support beam which is from 2 to 3 m above the rig floor. If necessary a support beam may be mounted in the drilling rig for this purpose. The piston and cylinder assembly 301 is then mounted on the carriage 311 and clamped in position. The tubular cutting apparatus 100 is then attached to the free end 313 of the piston and cylinder assembly 301 which is moved with respect to the mounting assembly 302 so that, at full extension, the apparatus 100 is in the desired position with respect to the casing string 200'. In normal use the apparatus 100 can be moved towards and away from well center by extending and retracting the hydraulic piston and cylinder 303. The outer barrel 304, intermediate barrel 305 and inner barrel 306 extend and contract with the hydraulic piston and cylinder 303 and provide lateral rigidity to the structure. At full extension the piston and cylinder assembly 301 can be deflected from side to side by a small amount. This movement can readily be accommodated by the two stage hydraulic piston and cylinder 303 although, if desired, the ends thereof could be mounted on, for example, ball and socket ioints or resilient mountings.

FIGS. 11A and 11B are perspective views showing the alternative cantilevered arm of FIG. 10 in first and second inoperative positions, respectively. It will be appreciated that when the piston and cylinder assembly 301 is fully retracted the free end 313 will lie immediately adjacent the extremity 314 of the outer barrel 104. In particular, the clamp assembly 312 can simply be slackened, the piston and cylinder 301 slid on the carriage 311 until the extremity 314 lies adjacent the mounting assembly 302 and the clamp assembly 312 re-tightened. When the piston and cylinder assembly 301 is fully contracted the free end 313 of the piston and cylinder assembly 301 lies closely adjacent the mounting assembly 302. This can clearly be seen in FIG. 11A. It will be noted that the piston and cylinder assembly 301 lies on an upwardly extending axis and that a major portion of the piston and cylinder assembly 301 lies to the rear of the mounting assembly 302. It will be noted that in this position the apparatus 100 rests on the workshop floor which simulates the drilling floor. An alternative inoperative position is shown in FIG. 11B. In this position the apparatus 100 is suspended from an overhead cable 160 (see FIG. 1) whilst the piston and cylinder assembly 301 again lies along an upwardly extending axis.

For certain operations it may be desirable to remove the band saw 120 completely. In such a case the apparatus 100 can simply be parked in the inoperative position shown in FIG. 4 or FIG. 5. Preferably, a locking device is provided to ensure that the piston and cylinder assembly 301 remains in its parked position. The apparatus 300 is preferably made of aluminum and is thus comparatively light and easy to handle.

Various modifications to the apparatus 300 are envisaged. For example, a small hydraulic motor could be provided to move the piston and cylinder assembly 301 with respect to the mounting assembly 302. If desired, means could be provided to enable the outer barrel 304 to be swivelled with respect to the mounting assembly 302 or the mounting assembly 302 itself to be capable of swivelling movement. If desired the piston and cylinder assembly 303 could be pneumatically actuable although this would give this arrangement some "bounce" which might not be desired.

In the arrangement of FIG. 1, the apparatus 100 is further supported by an overhead hoisting system. Cables 160 from the hoisting system are visible in FIG. 1. In one aspect, the hoisting system maneuvers the tubular severing apparatus 100, with the telescoping section 112 of the arm 110 moving in response. In another aspect, the telescoping section 112 of the arm 110 is hydraulically powered, causing the apparatus 100 and the supporting cables 160 to advance and recede in response to movement of the arm 110. Alternatively, the arm 110 and the hoisting system may be independently powered.

Further details concerning the operation of a suitable telescoping arm are found in the pending application entitled "Apparatus for Positioning a Tong." Ser. No. 09/355,439, and was filed on Nov. 29, 1999, now U.S. Pat. No. 6,412, 553. That application is incorporated by reference herein, in its entirety.

Also visible in FIG. 1 is a section of casing 200'. Casing section 200' represents an upper, severed string of casing that is being retrieved from a wellbore (not shown in FIG. 1). The casing 200' is being further severed into smaller portions for ease of manipulation and disposal. The exemplary casing string 200' houses a smaller, inner string of casing 205 nested within an outer casing string 200. The inner string 205 has been cemented into the outer string 200 in connection with earlier wellbore completion operations.

Figure 2:
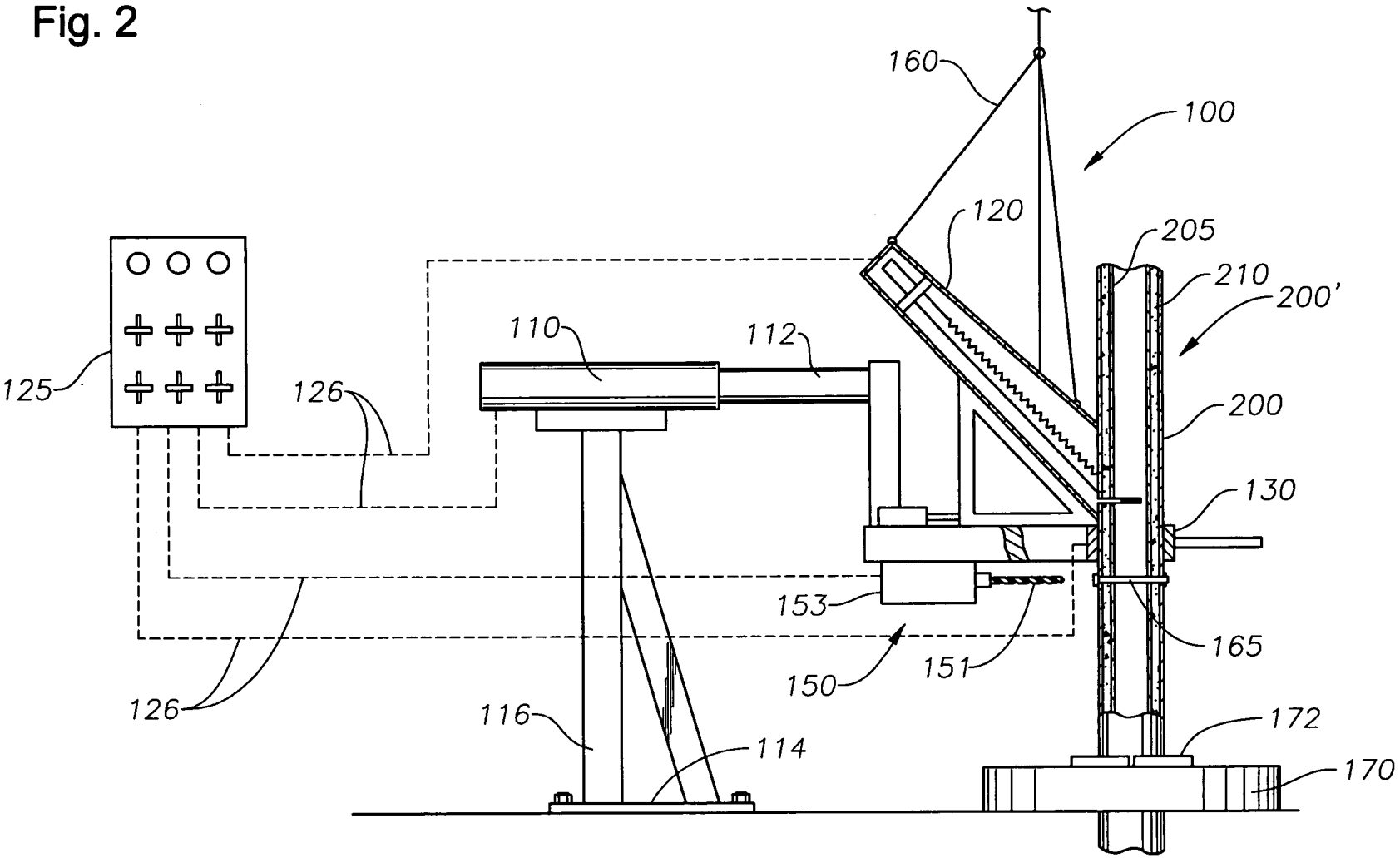
FIG. 2 is a side, schematic view of the tubular severing apparatus of FIG. 1.

FIG. 2 is a schematic view of the apparatus 100, adjacent a section of casing 200'. Visible again in FIG. 2 is the clamp assembly 130, the drill assembly 150 and the cutting assembly. In this arrangement, the assembly 100 is again disposed at the distal end of the telescopic arm 110 and is suspended from above with cables 160. The telescopic arm 110 again has at least one telescoping section 112.

In FIG. 2, the clamp assembly 130 is radially disposed about the section of casing 200' so as to secure the casing section 200' for severing. The casing 200' is shown in FIG. 2 in cross-section. Visible in this view are the outer casing string 200, the inner casing string 205 and a matrix of cured cement 210 in the annular region between the two casing strings 200, 205.

Figure 3:
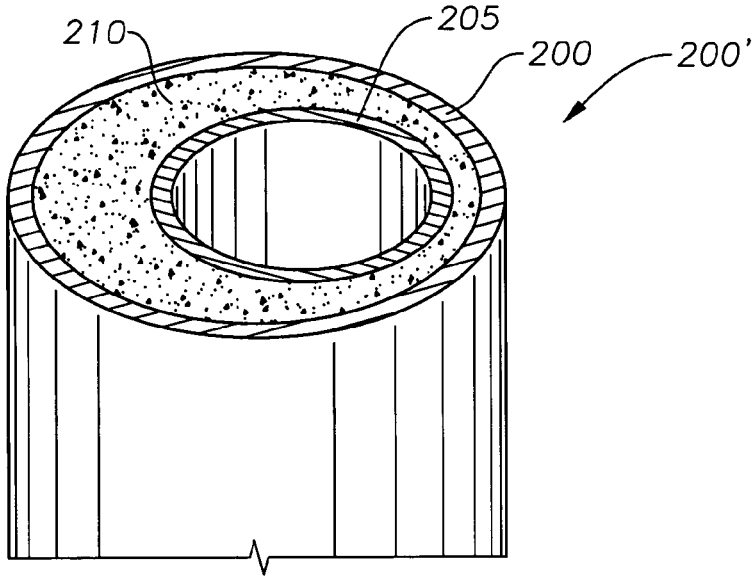

FIG. 3 is a perspective view showing a cross-section of the casing 200' after it has been severed using the apparatus 100 of FIG. 2. As previously described, casing section 200' defines an outer string of casing 200 which houses a smaller diameter casing 205. A matrix of cement 210 is disposed in an annular area between the two casing strings 200, 205. In this view, inner casing string 205 is eccentric relative to the surrounding outer casing string 200, as is typical in a completed wellbore.

Referring back to FIG. 2, the tubular string 200' is shown being held above a floor member 170 by a set of slips 172. The slips 172 permit the tubular string 200' to be raised from below the surface of the platform to some height. Typically, elevators (not shown) are provided on a rig for maneuvering pipe relative to the wellbore. The slips 172 hold the casing 200' so that it can be clamped and severed by the apparatus 100 after positioning of the casing 200' by the elevators.

As noted, the apparatus 100 includes a drill assembly 150. The purpose of the drill assembly 150 is to form an aperture through the casing strings 200, 205 for insertion of a retention member 165. Preferably, the retention member 165 defines a pin configured to be received within the formed aperture. Various pin types may be used, including, for example, a cylindrical bar, a cotter pin, or a cotter and key. In FIG. 2, a simple tubular pin is shown. The pin 165 serves to anchor any nested casing string 205 and cement 210 to the outer casing string 200. Preferably, the aperture is formed completely through both the front and back walls of the outer casing string 200, and the pin 165 is inserted completely through the outer casing string 200.

In the arrangement of FIG. 2, the drill assembly 150 is disposed below the band saw 120. The drill assembly 150 is constructed and arranged to insert a rotating drill bit 151 essentially perpendicular to the longitudinal axis of the casing string 200'. In this way, a suitable aperture is formed. Any known drilling device may be employed for boring a through-opening into the casing section 200'. The drill assembly 150 of FIG. 2 utilizes a rotary motor (not shown) inside of a housing 153 to rotate a single drill bit 151. A positioning device is further provided for selectively advancing the drill bit 151 towards and away from the casing section 200. In one aspect, a hydraulic cylinder 156 is used to advance the drill bit 151 towards and away from the casing section 200' by adjusting flow and pressure of hydraulic fluid.

An enlarged perspective view of a drill assembly 150 in operation is shown in FIG. 4. The drill bit 151 can be more clearly seen penetrating the wall of the outer section of casing 200. The drill assembly 150 typically operates with a source of coolant and advances forward towards the casing 200 by means of a telescoping positioning device, shown in FIG. 4 as a cylinder 156. In one aspect, the drill assembly 150 is operated remotely from a control panel 125 as is shown in FIG. 2. The remote control panel 125 will be more fully described, infra.

Figure 5A:
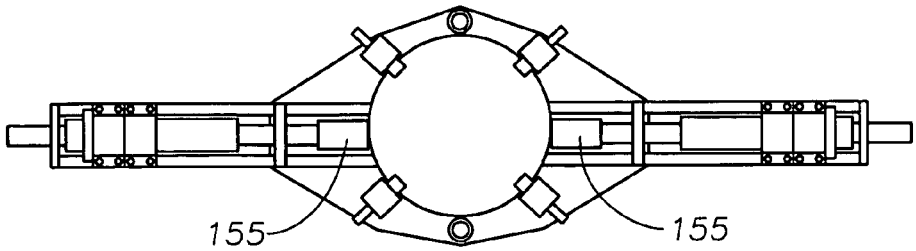
FIG. 5*a* is a top view showing an alternate embodiment of a drill assembly of the present invention.
Figure 5B:
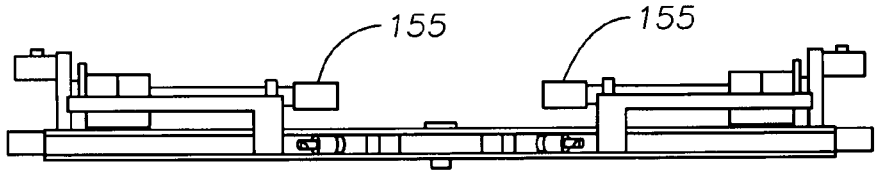
FIG. 5*b* presents a side view illustrating the drill assembly of FIG. 5*a*.

An alternative arrangement for a drill assembly is presented in FIGS. 5*a* and 5*b*. FIG. 5*a* is a top view of an alternate embodiment of a drilling assembly for the present invention. FIG. 5*b* is a side view thereof. In this arrangement, a pair of opposing boring devices 155 are urged inwardly towards the center of the casing section 200'. Again, it is within the spirit of the present invention to employ any drilling assembly 150 capable of boring an aperture through the casing section 200' for insertion of an anchoring pin 165.

Referring again to FIG. 2, it can be seen that the drill assembly 150 has been actuated to form an aperture through both casings strings 200, 205. The pin 165 has been inserted through the formed aperture to anchor the inner casing 205 to the outer casing 200.

Figure 6:
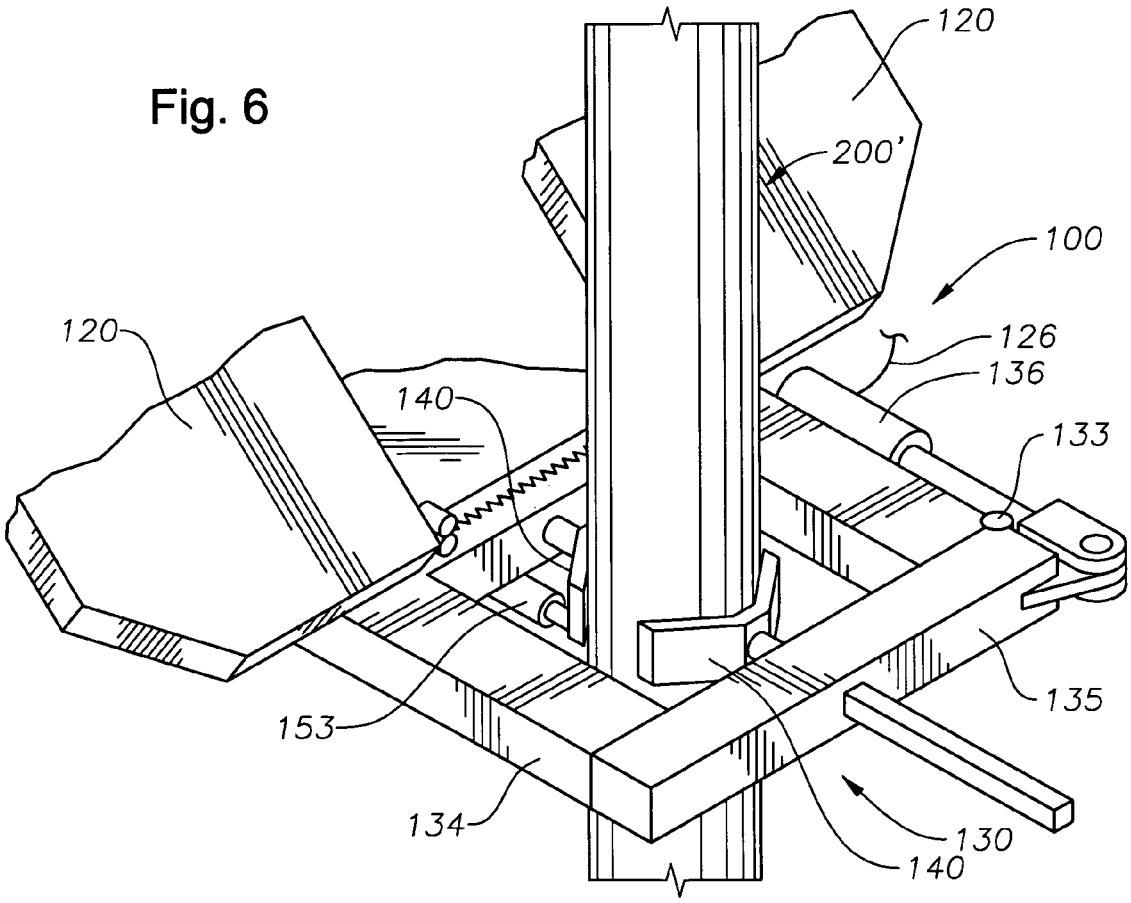
FIG. 6 is a perspective view illustrating the tubular severing apparatus of FIG. 1. In this view, the clamping assembly is more clearly seen. The clamping assembly is shown clamping a casing section. Also visible is the band saw being used to cut through the casing section.

FIG. 6 is a perspective view of the apparatus 100 of FIG. 1. In this view, the clamp assembly 130 is more clearly seen. The clamp assembly 130 includes a frame 134 that selectively radially encompasses the casing section 200' in order to secure the apparatus 100 to the casing section 200'. The clamp assembly 130 further comprises at least two clamp members 140 for frictionally engaging the casing 200'. In the arrangement of FIG. 6, the clamp members 140 each define a pair of angled support blocks which are moved into contact with the casing 200'. However, other arrangements may be employed, such as a single block having a concave surface.

The clamp assembly 130 includes a gate member 135 that swivels about a hinge 133 mounted on the frame 134. The hinge 133 permits the gate member 135 to be selectively opened and closed for receiving and for clamping the casing 200'. In the view of FIG. 6, the gate member 135 is closed about the casing 200' while the casing section 200' is being severed. The gate member 135 includes at least one clamp member 140 for engaging the casing 200' in its closed position. The gate 135 preferably operated with hydraulic power, and is remotely operated from control panel 125. A hydraulic arm 136 is shown to aid in remotely opening and closing the gate 135.

Figure 7:
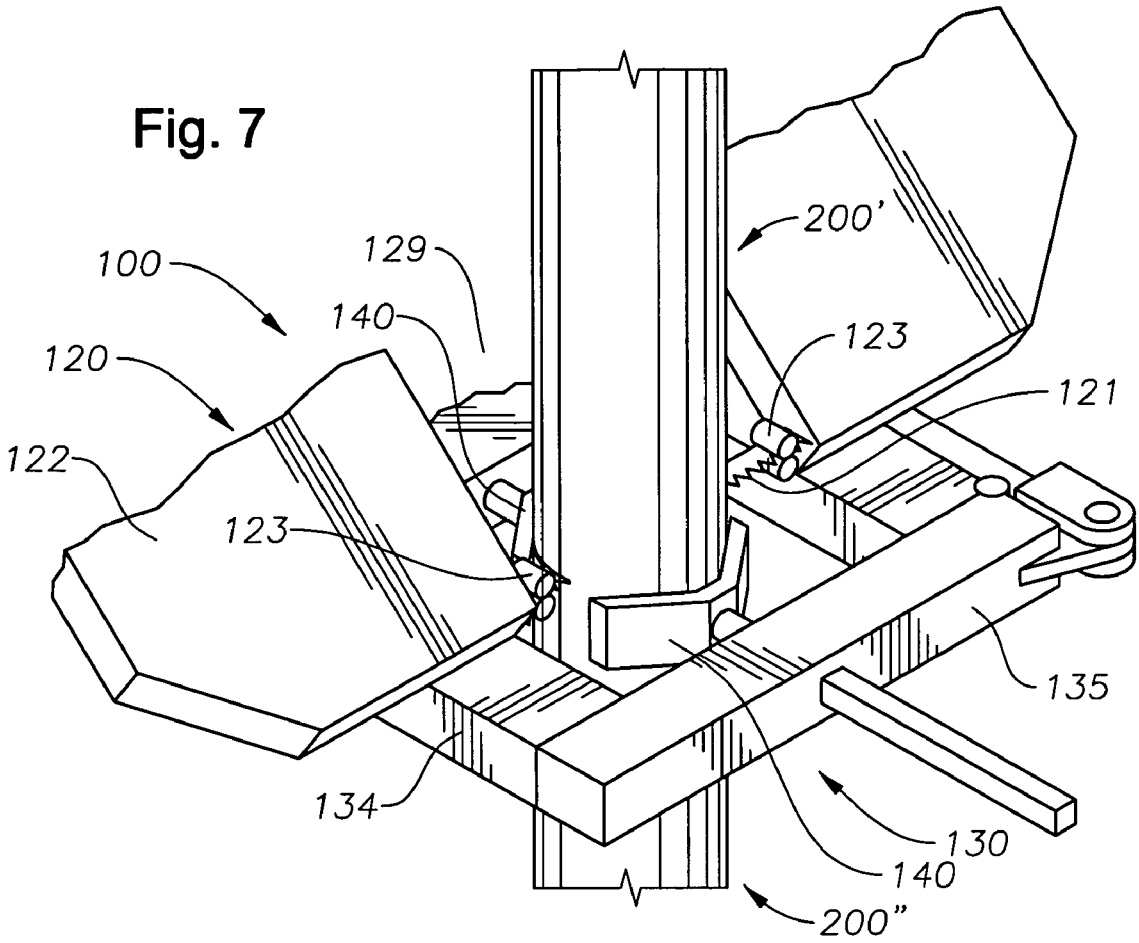
FIG. 7 is also a perspective view illustrating the tubular severing apparatus of FIG. 1. In this view, features of an exemplary band saw are more clearly. The band saw is again shown cutting a casing section.

FIG. 7 presents the apparatus 100 of FIG. 1 in still greater detail. In this perspective view, the cutting assembly is more clearly seen. The cutting assembly is shown as a band saw. The band saw 120 first comprises a housing 122. The housing 122 houses a pair of wheels (not seen in FIG. 7) about which a band saw blade 121 is tracked. The band saw blade 121 includes a plurality of teeth. The blade 121 is fed through pairs of roller members 123 which guide the blade 121 to cut in a direction substantially perpendicular to the longitudinal axis of the outer casing 200. One pair of roller members 123 is preferably provided at the housing outlet for the blade 121. In this respect, the blade 121 is fed through this first pair of roller members 123. A second pair of roller members 123 is disposed at the opening in the housing 122 through which the blade 121 is received back into the housing 122. The roller members 123 are more clearly seen in the enlarged view of FIG. 8.

It is within the spirit of the present invention to utilize any cutting device known for severing casing, so long as the cutting device may be adapted to operate in conjunction with a clamp assembly 130 and a drill assembly 150. In the exemplary arrangement for a cutting assembly of FIG. 7, the cutting assembly defines a band saw 120. Further, the band saw 120 includes a housing 122 that is offset from the angle of cutting by the blade 121. In other words, the angle of the housing 122 of the band saw 120 is offset from the angle at which the teeth of the blade 121 engage the outer casing 200 during the cutting operation. The angle shown is approximately 30 degrees, though other angles may be used. In addition, an enlarged spacing 129 is provided in the housing 122 between the wheels. These features accommodate placement of and access to the drill assembly 150 and clamp assembly 130. The spacing 129 in the housing 122 is more importantly sized to receive the casing 200' as the blade 121 of the saw 120 advances through the casing 200' during a cuffing operation.

Figure 8:
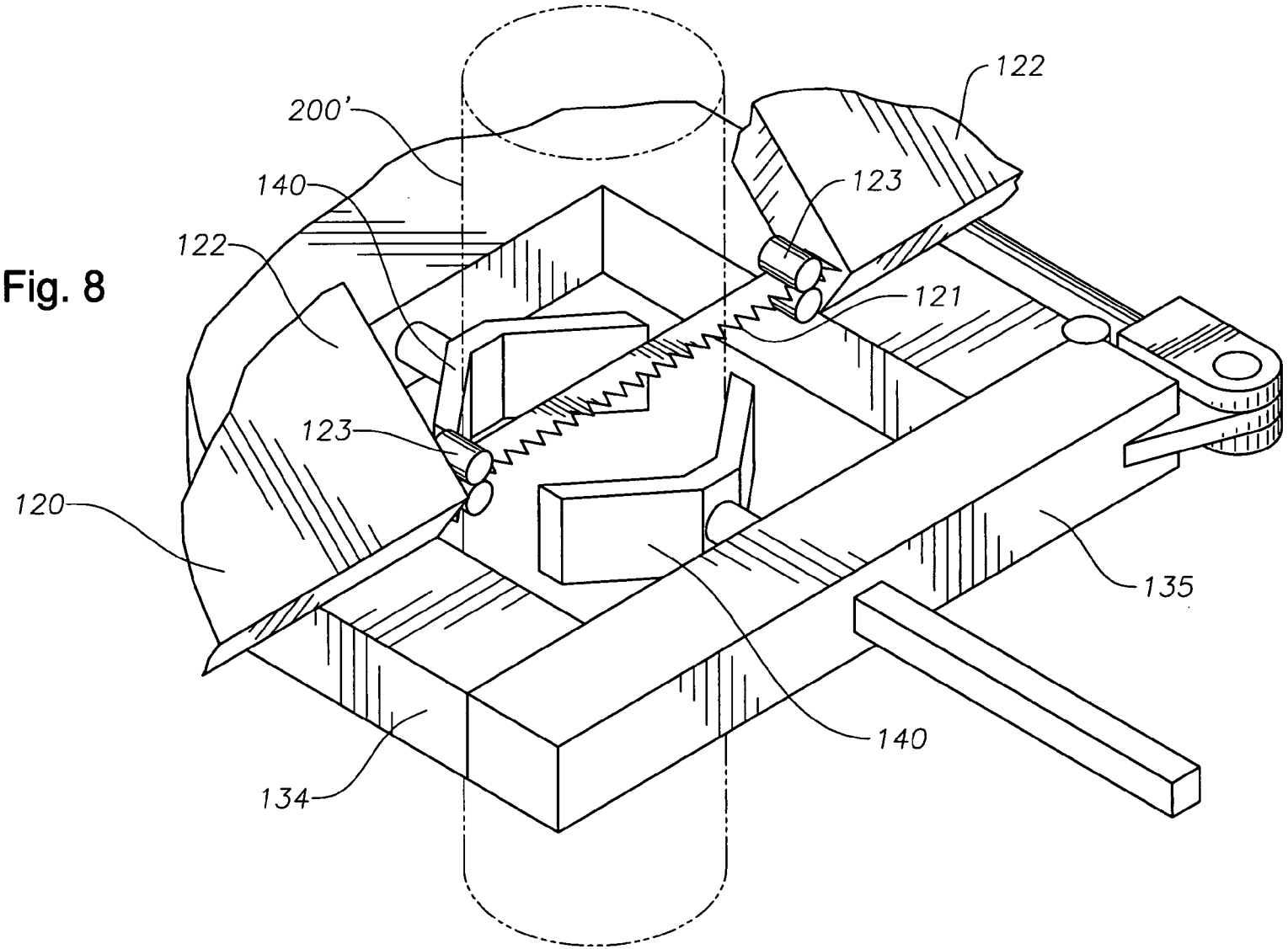
FIG. 8 is an enlarged view of the band saw of FIG. 7.

In the drawings of FIG. 7 and FIG. 8, the blade 121 of the band saw 120 has been actuated. In addition, the blade 121 is engaging the casing section 200', and has advanced partway through the casing 200' to form a cut that is substantially perpendicular to the longitudinal axis of the outer casing 200.

Figure 9:
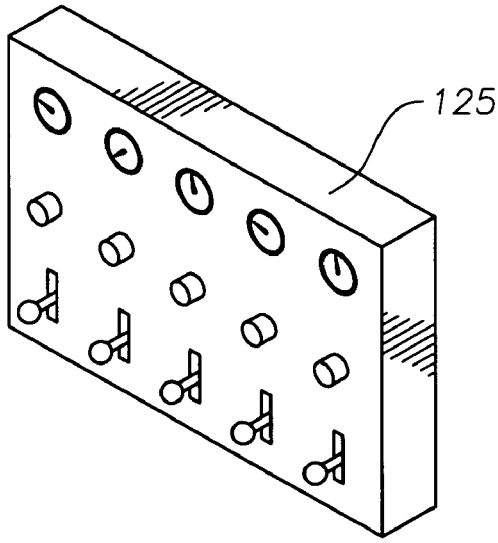
FIG. 9 is a perspective view of a control panel as might be used to control various portions of the severing apparatus of the present invention.

Referring again to FIG. 2, the band saw 120, the clamp assembly 130, and the drill assembly 150 are preferably controlled in an automated fashion from a control panel 125. Control lines 126 are provided from the control panel 125 to control the assembly 100, e.g., parts 120, 130, 150, etc. FIG. 9 is a more detailed perspective view showing a typical control panel 125 to be utilized with a tubular severing apparatus 100. The illustrated control panel 125 in one aspect includes separate controls to operate the clamp assembly 130, the drilling assembly 150, and the band saw 120.

The band saw 120 and the drill assembly 150 are typically operated with similar controls. For example, the drill assembly 150 and saw 120 each require an on/off control and a rotational speed control to manipulate the rotation of the saw blade 121 or the drill bit 151. Corresponding gauges illustrating the rotational movement of the drill bit 151 and the band saw 121 as shown in revolutions per minute may optionally be provided. In addition, a tool advancing control is provided to control the speed of advance of the drill bit 151 into the casing 200' and the blade 121 of the band saw 120 into the casing 200'. Corresponding positioning devices 127 (shown in FIG. 1) and 156 (shown in FIG. 4) are provided for the band saw 121 and the drill assembly 150. These positioning devices, 126, 156, in one aspect, represent telescoping hydraulic cylinders. These devices permit the drill bit 151 of the drill assembly 150 and the blade 121 of the band saw 120 to be independently, selectively advanced towards the casing 200' during the respective drilling and cutting operations and then withdrawn.

In addition, both the band saw 120 and the drill assembly 150 optionally include pressure sensors to determine the amount of pressure placed upon the casing by the rotating drill bit 151 or the rotating saw blade 121. Gauges may be provided at the control panel 125 indicating pressures on the drill bit 151 or the rotating saw blade 121. For example, core heads and saw blades provided by Mirage Tool Co ltd. (U.K.) and core heads from Alf I Larsen (Norway) may be used.

The clamp assembly 130 also has controls that are located on the control panel 125. For instance, the clamp assembly 130 includes a panel-mounted control which opens and closes the gate 135 located on the clamp assembly 130. Optionally, a gauge indicating pressure between the casing 200' and a clamp 140 may be provided and pressure of the clamps 140. A corresponding sensor is positioned on at least one of the clamp members 140 for sensing pressure of the clamp member 140 against the casing 200 when the gate 135 is closed. Preferably, the sensor is placed on the clamp member 140 on the gate 135.

In use, the severing apparatus of the present invention operates as follows:

First, a casing cutting means (not shown) is run into a wellbore. The cutting means is typically disposed on the end of a run-in string or wireline. The cutting means is placed in the wellbore at a predetermined depth, and then actuated. In this way, a selected length of casing is severed downhole. Thereafter, the severed portion of casing 200 is pulled or "jacked out" of the wellbore and lifted to the rig platform within an elevator.

A predetermined amount of the severed portion of casing 200' is pulled upwards past the slip 172 located at the level of the platform floor. The casing 200' is held in place by the slip 172, exposing the upper portion of the casing 200' above the platform floor. Thereafter, a tubular severing apparatus 100 of the present invention is moved towards the casing 200' by the telescopic arm assembly 110 with its extending and retracting sections 112. As the apparatus 100 reaches a location proximate to the casing 200', the clamp assembly 130 is actuated to open the gate 135 and to receive the casing 200'. The gate 135 is then closed around the casing 200', and the clamp assembly 130 is secured to the casing 200' by the clamping members 140. In this way, the severing apparatus 100 is properly positioned with respect to the casing 200'.

Thereafter, with the outer casing string 200 clamped in the apparatus 100, the drill assembly 150 is operated. Preferably, remote actuation of the drill assembly 150 is conducted through the control panel 125. The drill bit 151 disposed on the drill assembly 150 is rotated and advanced towards the casing 200 to form an aperture therein. The aperture is created through at least the front wall of the casing section 200' at an angle substantially perpendicular to the longitudinal axis of the outer casing 200. A retention mechanism such as a pin 165 is then inserted through the casing 200' to ensure that any inner string of casing 205 is longitudinally fixed with respect to the outer string of casing 200.

The next step involves actuation of the band saw 120. Preferably, actuation of the band saw 120 is performed remotely via the control panel 125. The blade 121 of the band saw 120 is actuated, and is advanced through the casing 200' at a point above the pin 165. The retention pin 165 anchors the smaller diameter casing 205 within the larger diameter casing 200. In this manner, the inner 205 and outer 200 casing strings in the lower section 200" are prevented from separating below the rig floor. The severed portion of the casing section 200' is then lifted away, leaving an upper end of the lower portion of casing 200" remaining within the clamping assembly 130.

Once the severed piece of casing 200' has been disposed of, an elevator or other lifting device works with the slips to lift the casing 200' another predetermined distance upwards. The slips 172 are then used to re-grasp the casing 200' for the operation to be repeated. Each time a severing operation is completed, the clamp assembly 130 is de-activated, and the gate 135 is reopened so that the apparatus 100 can move away from the severed piece of casing 200'. In addition, it is noted that the pin 165 may be retained in the newly lifted section of casing 200' to be severed. A new pin 165 can then be inserted once a new aperture is formed within the casing 200'.

As demonstrated in the foregoing disclosure, the apparatus 100 of the present invention provides a safe and efficient means for severing casing during a plug and abandonment operation. In one aspect, the apparatus 100 is operated via a remotely located control panel 125.

While the foregoing is directed to embodiments of the present invention, other and further embodiments of the invention may be devised without departing from the basic scope thereof, and the scope thereof is determined by the claims that follow.

The invention claimed is:

1. An apparatus for cutting a nested string of tubulars above a wellbore, comprising:

a band saw configured to receive the nested string so that the band saw may cut through the nested string in a direction substantially perpendicular to a longitudinal axis of an outer tubular of the nested string and at any location along the longitudinal axis of the outer tubular, wherein the nested string has a substantial length;

a support beam; and a single cantilevered extendable structure having a first end and a second end, the extendable structure attached to the support beam at the first end and coupled to the band saw at the second end.

2. The apparatus of claim 1, wherein the extendable structure is a telescoping arm comprising an outer section and an inner section.

3. The apparatus of claim 2, wherein the telescoping arm is pivotable about a vertical axis.

4. The apparatus of claim 2, wherein the telescoping arm is pivotable about a horizontal axis.

5. The apparatus of claim 2, wherein the telescoping arm further comprises an intermediate section.

6. The apparatus of claim 5, wherein:

at least a portion of the inner section is slidably mounted in the intermediate section; and at least a portion of the intermediate section is slidably mounted in the outer section.

7. The apparatus of claim 2, wherein the tubular severing assembly is attached to the inner section and the outer section is attached to the support beam.

8. The apparatus of claim 2, further comprising a clamp for securing the outer section to the support beam.

9. The apparatus of claim 8, wherein the outer section is movable between a first position and a second position relative to the support beam.

10. The apparatus of claim 9, further comprising a motor actuatable to adjust the position of the extendable structure with respect to the support beam.

11. The apparatus of claim 9, wherein the clamping assembly is releasably connected to the support beam.

12. The apparatus of claim 1, further comprising:

a base; and a clamp attached to the support beam, wherein:

the extendable structure is attached to the support beam by the clamp at the first end, and the support beam is an essentially vertical support beam.

13. The apparatus of claim 1, further comprising a clamp assembly attached to the extendable structure at the second end for holding the outer tubular in relation to the apparatus.

14. The apparatus of claim 13, wherein the clamp assembly comprises:

a frame;

at least two clamp members for frictionally engaging the outer tubular;

a hinge mounted on the frame; and a gate movable on the hinge for selectively opening and closing the clamp assembly, the gate having at least one clamp member disposed thereon.

15. The apparatus of claim 1, wherein the band saw comprises a housing having an enlarged spacing formed therein and the spacing is configured to receive the outer tubular having a diameter of at least 13 and ⅜ inches.

16. A method of using the apparatus of claim 1, comprising:

providing the apparatus of claim 1; and cutting through the nested string of tubulars using the band saw.

17. An apparatus for cutting a nested string of tubulars above a wellbore, comprising:

a band saw comprising a blade and a housing, wherein the housing is inclined relative to a direction of cutting of the blade by an acute angle;

a support beam of a drilling rig, the support beam having at least a portion above a floor of the drilling rig; and an extendable structure having a first end and a second end, the extendable structure attached to the support beam at the first end and coupled to the band saw at the second end.

18. The apparatus of claim 17, wherein the extendable structure is made of a light material.

19. The apparatus of claim 17, wherein the extendable structure is made of aluminum.

20. The apparatus of claim 17, wherein the support beam is substantially horizontal.

21. The apparatus of claim 20, wherein the support beam is at least two meters above the floor.

22. The apparatus of claim 17, wherein the extendable structure is a single cantilevered extendable structure.

23. The apparatus of claim 22, wherein the extendable structure is a telescoping arm comprising an outer section and an inner section.

24. The apparatus of claim 17, wherein the extendable structure is portable.

25. The apparatus of claim 17, further comprising a clamp assembly attached to the extendable structure at the second end for holding the nested string in relation to the apparatus.

26. The apparatus of claim 25, wherein the clamp assembly comprises:

a frame;

at least two clamp members for frictionally engaging the nested string;

a hinge mounted on the frame; and a gate movable on the hinge for selectively opening and closing the clamp assembly, the gate having at least one clamp member disposed thereon.

27. The apparatus of claim 17, wherein the housing has an enlarged spacing formed therein and the spacing is configured to receive the outer tubular having a diameter of at least 13 and ⅜ inches.

28. The apparatus of claim 18, wherein the angle is approximately 30 degrees.

29. A method of using the apparatus of claim 17, comprising:

providing the apparatus of claim 17; and cuffing through nested string of tubulars using the band saw.

30. An apparatus for cutting a nested string of tubulars above a wellbore, comprising:

a band saw comprising a blade and a housing, wherein the housing has an enlarged spacing formed therein configured to receive the nested string and the spacing is inclined relative to a longitudinal axis of an outer tubular of the nested string;

a support beam of a drilling rig, the support beam having at least a portion above a floor of the drilling rig; and an extendable structure having a first end and a second end, the extendable structure attached to the support beam at the first end and coupled to the band saw at the second end.

31. An apparatus for cutting a nested string of tubulars above a wellbore, comprising:

a band saw comprising a blade and a housing, wherein the housing is offset from an angle of cutting of the blade;

a support beam of a drilling rig, the support beam having at least a portion above a floor of the drilling rig; and an extendable structure having a first end and a second end, the extendable structure attached to the support beam at the first end and coupled to the band saw at the second end.

* * * * *

UNITED STATES PATENT AND TRADEMARK OFFICE

CERTIFICATE OF CORRECTION

PATENT NO. : 7,156,170 B2
APPLICATION NO. : 11/006050
DATED : January 2, 2007
INVENTOR(S) : Fotland et al.

It is certified that error appears in the above-identified patent and that said Letters Patent is hereby corrected as shown below:

On the Title page:

In Section (75) Inventors: please delete "Hundvaag (NO)" and insert --Dubai (AE)--.

In Section (63) Related U.S. Application Data, Line 1, pelase delete "Continuation-in-part" and insert --Continuation--.

In the Claims:

In Column 12, Claim 28, Line 48, please delete "18" and insert --17--;

In Column 12, Claim 29, Line 53, please insert --the-- between "through" and "nested".

Signed and Sealed this

Tenth Day of July, 2007

JON W. DUDAS
*Director of the United States Patent and Trademark Office*